United States Patent [19]

Honeycutt, Jr.

[11] 3,951,459

[45] Apr. 20, 1976

[54] COAL MINING APPARATUS AND METHOD

[76] Inventor: Dewitt W. Honeycutt, Jr., 5881 Preston View No. 254, Dallas, Tex. 75240

[22] Filed: Oct. 16, 1974

[21] Appl. No.: 515,206

[52] U.S. Cl. ..... 299/11; 37/87; 299/18; 299/30

[51] Int. Cl.[2] ..... E21C 41/00

[58] Field of Search ..... 299/11, 30, 31, 33, 299/18; 61/72.5–72.7; 37/87, 190

[56] References Cited

UNITED STATES PATENTS

| | | | |
|---|---|---|---|
| 1,684,869 | 9/1928 | Krueger | 37/87 |
| 1,856,216 | 5/1932 | Jaeger | 37/87 |
| 2,711,634 | 6/1955 | Joy | 299/11 X |

*Primary Examiner*—Ernest R. Purser
*Attorney, Agent, or Firm*—Hubbard, Thurman, Turner & Tucker

[57] ABSTRACT

Coal mining apparatus for removing subterranean material with minimal disruption of the overburden includes a mobile underground mining machine having rotary cutters mounted on the front of the machine for drilling coal in a coal deposit. The underground machine is track driven with an overhead protective shield to support the overburden above the machine as it digs into the coal deposit. The protective shield is slanted downward toward the rear of the mining machine to gradually lower the overburden as the mining machine passes under, thus replacing the excavated coal while minimizing disturbances on the surface. An elevator shaft is mounted on the underground mining machine and extends vertically upward to the earth's surface. A mobile track vehicle is attached to the elevator shaft at the surface and is coordinated to move in synchronization with the underground mining machine. A conveyor system transports coal from the rotary cutters through the vertical elevator shaft to the surface vehicle where it is loaded onto a transport vehicle. An endless chain digger is provided on the outside of the elevator shaft to cut a vertical passageway through the overburden to facilitate movement of the elevator shaft with the surface and underground machines.

30 Claims, 11 Drawing Figures

COAL MINING APPARATUS AND METHOD

BACKGROUND AND SUMMARY OF THE INVENTION

The present invention is concerned with apparatus and methods for mining subterranean material, and more particularly with a coal mining machine and method for removing coal from beneath the surface of the earth with minimal disturbance of the overburden.

The demands of industry and society today require the utilization of all known energy sources. In many parts of the United States and other areas of the world, there exists an abundance of coal lying at a shallow depth below the surface of the earth. These coal deposits represent a potential source of relatively easily accessible and inexpensive fuel. The primary means of recovering this shallow lying coal is by strip mining, that is removing the overburden including top soil and foliage and then digging directly into the coal deposits. After the strip mining has been completed, the land is sometimes left without any treatment or attempt at restoration. In the absence of trees, grass and other types of foliage, soil erosion runs rampant due to flooding and wind storms. Moreover, the inversion of the overburden and the top soil exposes pyrites and other metallic ores to rapid oxidataion thereby weakening and leeching the soil and polluting adjoining waterways for many years. Thousands of acres of desolate land, particularly in the eastern United States, may be seen today as evidence of the destruction rendered by strip mining techniques.

The interest today of many private and governmental conservation entities in preserving the environment has led to various pressures on the coal mining industry to restore, at least in some measure, the landscape of strip mined areas and to seek alternate, less destructive methods for recovering shallow-lying coal. Despite considerable efforts by some coal mining companies to restore the land and leave it somewhat productive, it is doubtful that complete restoration can ever be accomplished on land which has been strip mined by present methods.

Moreover, alternate methods of mining shallow coal have been too expensive to be practical in many cases. One alternate approach is to utilize the methods of "longwall mining", a technique now limited to very deep coal beds where bedrock makes support relatively easy. Instead of removing the overburden, miners dig a narrow trench alongside the coal seam and a long tunnel horizontally along one end of the seam to form a passageway for setting up longwall machinery, including cutters, hydraulic roof supports and conveyors. As the cutters and conveyors work along the wall of the coal seam, new supports are erected next to the cutters and the old supports are removed allowing the roof to cave in and the overburden to drop. Thus, a considerable length of coal seam is mined but only a narrow trench need be refilled after the operation has been completed.

This technique is still in the experimental stage and it is yet to be seen whether longwall mining can be utilized in recovering shallow coal deposits. However, even if this approach is feasible, there are several disadvantages. Because of the need to constantly remove hydraulic roof supports and erect new roof supports, it is necessary that a number of miners work in the underground tunnel in close proximity to the cutters and conveyors. These workers are subject to the substantial danger of cave-ins because of the continual erection of new supports and the removal of old supports. The miners working near the equipment also face the possibility of becoming caught in the drilling and conveying systems. Furthermore, longwall mining would require substantial and expensive air conditioning equipment in order to make the underground excavation livable for miners. In addition, frequent shutdowns of the drilling and conveying apparatus could be expected in order to erect new hydraulic roof supports as the equipment moves forward against the wall of the coal seam. Finally, maintenance and servicing of the cutting and conveying systems and the hydraulic roof supporting system would be substantial.

The present invention concerns coal mining apparatus and methods for mining shallow coal deposits with minimal disturbance of the overburden. A remotely controlled underground mining machine having rotary cutters is directed along an underground coal seam. The coal is excavated from the underground machine through a vertical elevator to the surface to be loaded onto transport vehicles. A surface machine is connected to the vertical elevator and moves with the underground machine to provide guidance for the elevator shaft. A digging chain rotates around the vertical elevator shaft to cut a passageway for the shaft to move through the overburden as the underground machine and the surface machine advance. Fill dirt, cut by the digging chain, is dumped behind the surface machine to refill the passegeway. The overburden is gradually lowered by a slanted protective shield above the underground machine to fill the excavated area behind the underground machine.

In one aspect of the present invention, apparatus for removing subterranean material includes underground mobile means for moving beneath the overburden into the subterranean material. Mining means are connected to the mobile means for removing the subterranean material, and support means are mounted on the mobile means to move with the mobile means beneath the overburden and support a portion of the overburden above the mobile means.

In accordance with another aspect of the present invention, mining apparatus for removing coal from a subterranean coal seam utilizes a mobile mining machine with cutting means on the front for breaking the coal seam into separate pieces. A conveyor removes the coal pieces from in front of the mining machine, and a driving means moves the mobile mining machine forward as the cutting means and the conveyor open a passageway in the coal seam. A support means holds the overburden above the mobile mining machine and said cutting means to facilitate removal of the coal pieces. In accordance with a further aspect of the present invention, an elevator means is attached to the mobile mining machine and extends vertically upward to the surface. The elevator means includes a lifting elevator for transporting the coal pieces to the surface and digging means to cut a passageway for the elevator to move through the overburden. A surface vehicle is attached to the elevator means and is coordinated to move together with the underground vehicle and the elevator means.

In accordance with yet another aspect of the present invention, apparatus for moving subterranean material to the surface of the earth, includes mobile underground means, transporting means and mobile surface means. The underground means is moveable in the direction of the subterranean material and is adapted to process the material for conveying to the surface. The transporting means is connected to move in coordination with the mobile underground means and the mobile surface means and transports the processed material to the surface. The mobile surface means attached to the transporting means moves in coordination with the mobile underground means to receive processed subterranean material from the transporting means.

In another aspect of the present invention, a vertical shaft means extends from a mobile underground digging means to the surface of the earth for removing subterranean material from beneath the earth. Means are provided on the vertical shaft means for transporting the subterranean material to the surface. Drive means are mounted on the shaft means for moving the shaft through the earth in coordination with movements of the underground digging means.

Another aspect of the present invention includes mobile underground means for burrowing into subterranean material. Digging means break up the subterranean material and drive means moves the mobile underground means into the material. Transporting means are moveable with the mobile underground means to convey the subterranean material to a loading station.

In accordance with still another aspect of the present invention, a process for removing subterranean material uses a mobile underground mining machine. The overburden is supported above the mining machine and the subterranean material is processed into transportable form. The processed material is conveyed through the overburden to the earth surface and the supported overburden is lowered behind the mobile mining machine as the machine moves forward through the subterranean material.

Another aspect of the present invention concerns a process for removing subterranean material using a mobile underground mining machine continually moving toward the subterranean material. The material is broken into transportable pieces by the mining machine and lifted by a conveyor through the subterranean material to the surface. A passageway is continually cut through the overburden for the conveyor, which extends from the mining machine to the surface, so that the conveyor can move through the overburden in coordination with the mining machine. Another aspect of the present invention includes a process for mining coal from an underground coal deposit using a mobile underground machine, a mobile surface vehicle and an interconnecting conveyor shaft. The underground machine burrows into the coal deposit and breaks the coal into transportable pieces. The pieces are conveyed through the overburden by the conveyor shaft to the mobile surface vehicle. The surface vehicle is driven in coordination with the underground machine and a passageway is cut through the overburden to provide a path for the conveyor shaft to move in coordination with the underground machine and the surface vehicle.

It can be seen from the foregoing that the present invention provides many advantages over previous mining apparatus. A shallow underground coal deposit may be removed with a minimum of disturbance of the surface above the coal. The narrow trenches that must be dug are subsequently filled by the dirt taken from the trenches. The overburden is lowered gradually behind the underground digging machine so as to cause little, if any, disturbance. The mobile trenching shaft cut between the underground machine and the surface vehicle to facilitate the separation of the overburden above the mined portion of the deposit from other subterranean material to allow the overburden to settle evenly behind the machine. The underground machine is controlled and powered remotely by a surface vehicle so so that underground workers are not needed. Extensive use of hydraulic supports and longwall cutting equipment is not required. The conveyor system of the present invention provides a simple means for transporting coal to the surface and loading it onto transport vehicles. Ready access to the underground machine is allowed through the trenching shaft.

DESCRIPTION OF THE DRAWINGS

A more complete understanding of the invention may be had by referring to the following detailed description when taken in conjunction with the accompanying drawings, wherein

Referring now to FIG. 1, coal mining apparatus 10 is shown for removing underground coal with minimal disruption of the earth's surface. The apparatus 10 includes a surface vehicle 12, an underground mining machine 14 and a trencher/elevator 16 extending through the overburden between vehicle 12 and mining machine 14. Surface vehicle 12 includes a prime mover 17, preferably a diesel motor which powers an electrical generator (not shown) and a pair of standard crawler tracks 18. An operator cabin 19 is provided at the front of the surface vehicle 12 for coordinating the movement of underground mining machine 14 with surface vehicle 12. Mounted on the front of underground mining machine 14 is a rotary cutter drum 20 having a plurality of cutter teeth 22 extending radially outward around the periphery of drum 20. Rotary cutter drum 20 extends transversely across the front of underground mining machine 14 and is adapted for rotation so that teeth 22 engage an underground coal deposit. Rotary cutter drum 20 and cutter teeth 22 are standard equipment normally available in the industry with minor modifications as necessary for adaption to the present invention.

With reference to FIGS. 1 and 2, rotary cutter drum 20 is mounted on support arms 174 which in turn are each pivotally attached to a scoop member 30 mounted on the front of mining machine 14 behind rotary drum 20. A hydraulic arm 24 is connected between each support arm 174 and scoop member 30 for vertical movement of the cutter drum 20 to increase the depth of the swath cut through the coal deposit by mining machine 14. A moveable overburden shield 26 is pivotally attached transversely across the front of mining machine 14 above rotary drum 20 to prevent the overburden 56 from falling on or behind the rotary drum 20. A hydraulic lifter arm 28 is attached between the underside of overburden shield 26 and scoop member 30 to pivot shield 26 vertically with movement of the rotary cutter drum 20. Scoop member 30 is mounted transversely across the front of the underground mining machine 14 directly behind rotary cutter drum 20 along the bottom of the swath cut by drum 20. A conventional track driving system 34 is located beneath the underground mining machine 14 behind scoop member 30 for moving machine 14. A rigid slanted cover 36 is provided above the driving system 34 extending from adjacent overburden shield 26 to the back of the track driving system 34. Cover 36 is slanted downward toward the back of mining machine 14 and terminates in the rounded portion 38 covering the back end of track driving system 34. A rectangular aperture 40 in the middle of slanted cover 36 provides an opening for trencher/elevator 16 to extend through and connect with underground mining machine 14. A pair of rubber shear mounts 42 is connected between an angle iron member 44 on the trencher/elevator and a support member 46 on the mining machine 14.

Figure 1:
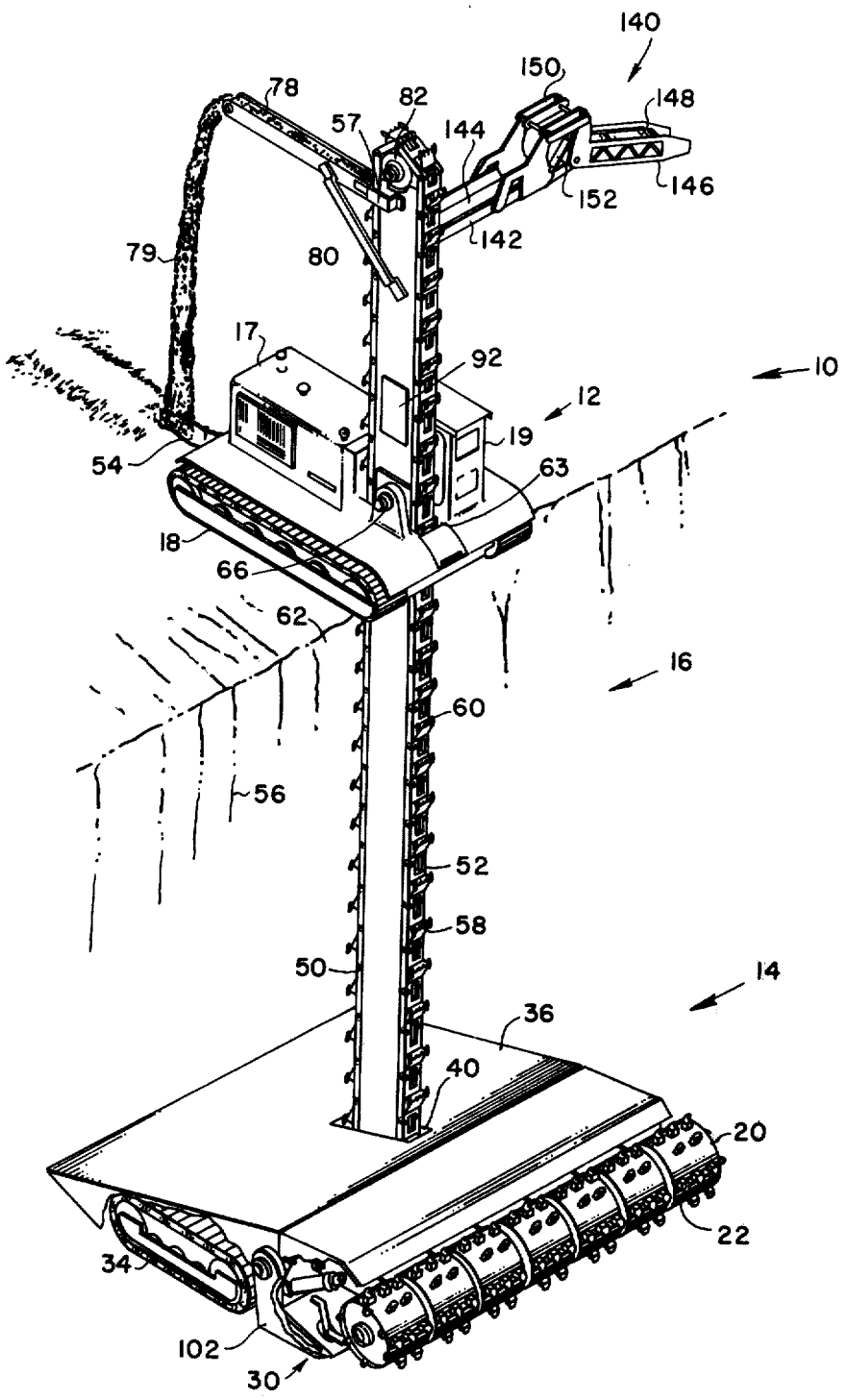
FIG. 1 is a perspective view of the coal mining apparatus of the present invention with the overburden partially cut away to reveal an underground mining machine and a trenching shaft.

Trencher/elevator 16 includes a rectangular elevator shaft 50, having narrow front and back sides, 70 and 71, and wider side faces 72 and 73, extending substantially vertically between underground mining machine 14 and surface vehicle 12. An endless trenching chain 52 is mounted on the narrow front and back sides 70 and 71 of elevator shaft 50 for cutting a vertical trench 54 in the overburden 56 between the underground mining machine 14 and the surface vehicle 12. A plurality of digging teeth 58 are spaced along trenching chain 52, each tooth 58 having an open mouth 60 facing upward along the front side of shaft 50 to carry overburden diggings 79 away from the front of trench 54.

Figure 6:
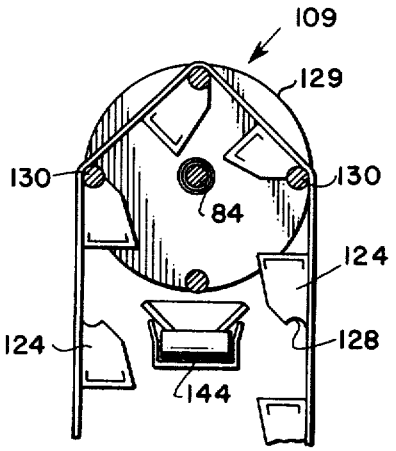
FIG. 6 is a partial side view of a support means for the trenching shaft of the coal mining apparatus of FIG. 2.
Figure 6:
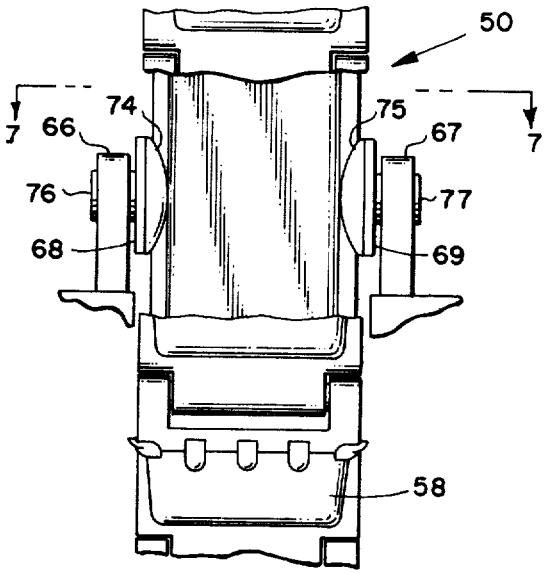

Elevator shaft 50 extends upward through the overburden 56 to the earth's surface 62 and through an opening 63 near the front of surface vehicle 12. Trunnion brackets 66 and 67 are vertically mounted on surface vehicle 12 adjacent faces 72 and 73. Slideable shoes 68 and 69 are rotatably attached to trunnion brackets 66 and 67 by pins 76 and 77. Bearings 64 and 65 interface between brackets 66 and 67 and pins 76 and 77 to provide for pitch motion of surface vehicle 12 relative to shaft 50. Shoe 68 is fitted between guide ribs 48 and 49 running longitudinally along the edges of face 72 of elevator shaft 50 adjacent trunnion bracket 66. Shoe 69 is similarly connected to bracket 67. As best seen in FIG. 6, shoe 68 has a cylindrical inner face 74 running transversely across shaft face 72. Cylindrical inner face 74 absorbs rolling motion of surface vehicle 12 with respect to trencher/elevator 16 while maintaining contact between vehicle 12 and trencher-/elevator 16. A similar cylindrical inner face is provided on shoe 69.

Figure 7:
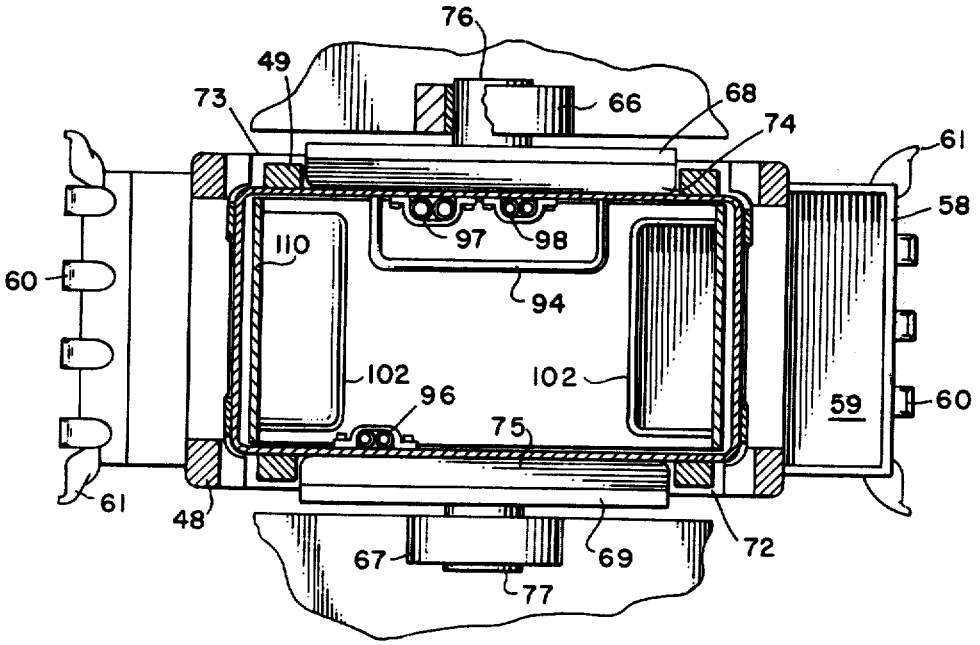
FIG. 7 is a plan cross sectional view of the trenching shaft of FIG. 6 taken along lines 7—7.

Trenching shaft 50 is hollow with an entry door 92 positioned above slideable shoe 68 in face 72 of shaft 50. As shown in FIG. 7, a metal rung ladder 94 extends longitudinally along the inner side of face 73 to the bottom of shaft 50. Power cables 96 are attached to run along the inner side of face 72 for communicating electrical power from surface vehicle 12 to the underground mining machine 14. Hydraulic lines 97 and television and electrical cables 98 also run down the inner side of shaft face 73 inside ladder 94 to provide hydraulic and electric power for running machine 16 and remote viewing of the underground mining operations for surface vehicle 12. Slideable shoes 68 and 69 are positioned adjacent shaft faces 72 and 73 between ribs 48 and 49 respectively. Digging teeth 58 are provided with front protrusions 60 and side protrusions 61 extending outward to loosen the overburden to be carried out of trench 54 by teeth 58. Alternate teeth 58 are provided with three and four front protrusions 60 respectively offset from each other.

Figure 3:
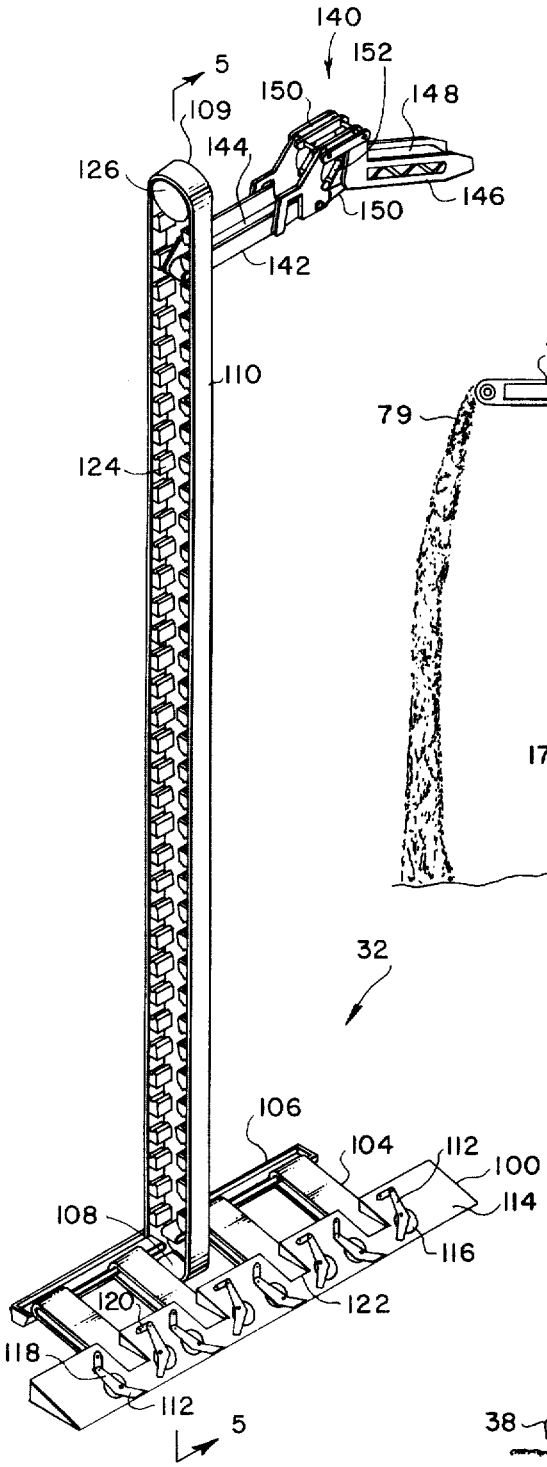
FIG. 3 is a detail perspective view of the coal conveyor system of the mining apparatus shown in FIG. 1.

Referring now to FIG. 3, a coal transporting system 32 is shown for conveying coal from the rotating cutter drum 20 to the earth's surface 62. A wedge-shaped member 100 is mounted transversely behind rotary cutter drum 20 on scoop member 30. A number of feed conveyors 104 run from wedge-shaped member 100 back to a pair of cross conveyors 106 feeding into opposite sides of the bottom 108 of trenching shaft 50. An endless conveyor belt 110 runs longitudinally inside trenching shaft 50 between the bottom 108 and the top 109 of shaft 50. Four pairs of gathering arms 112 are pivotally positioned along the forward face 114 of wedge-shaped member 100. Each arm 112 is mounted near the center to a rotating disk 116 and is connected at its upper end 118 to a rocker arm 120 to impart a rocking motion to each gathering arm 112 as the corresponding disk 116 rotates. Between each pair of gathering arms 112 is a groove 122 providing an opening for coal pieces to be directed by gathering arms 112 to feed conveyors 104. The opposite end of feed conveyors 104 is positioned above cross conveyors 106 which run into the bottom 108 of shaft 50.

Figure 5:
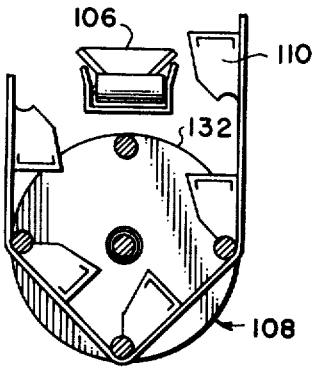
FIG. 5 is a partial cross section of the conveyor system shown in FIG. 3 taken along lines 5—5.

A plurality of elevator buckets 124 are spaced along the inner side of endless conveyor belt 110 for carrying coal pieces to the surface of the earth. As best shown in FIG. 5, buckets 124 are positioned to face upward along a side of belt 110 adjacent front shaft side 70 in order to convey coal to the top 109 of shaft 50. Buckets 124 are inverted at top 109 and are returned to bottom 108 for refilling. A loader conveyor 140 is positioned near the top 109 of trenching shaft 50 for loading trucks alongside surface vehicle 12. Loader conveyor 140 includes an inside loader arm 142 extending into the top 109 of trenching shaft 50 to pick up coal from elevator buckets 124. Inside loader arm 142 includes a conveyor belt 144 running the length of arm 142 and powered by suitable means (not shown). Adjacent to the outer end of inside loader arm 142 is an outside loader arm 146 also having a conveyor belt 148 running its full length. Outside loader arm 146 is pivotally attached to the end of inside loader arm 142 by upper and lower pivot pieces 150. A hydraulic cylinder 152 is connected between inside loader arm 142 and outside loader arm 146 so that the outside loader arm 146 may be pivoted upward to allow conveyor belt 144 to load directly into an adjoining truck. A second truck running further away from surface vehicle 12 may be loaded by lowering and using outside loader arm 146.

Figure 4:
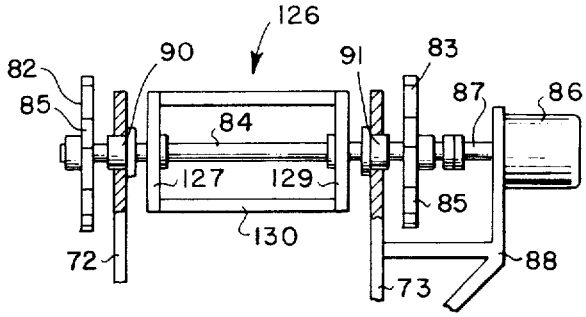
FIG. 4 is a plan cross section of the driving system for the conveyor system of FIG. 3 taken along lines 4—4 in FIG. 2.

Referring now to FIG. 4, a trench shaft system 81 is shown for driving the coal transporting system 32 and the trenching chain 52. An electric motor 86, mounted on a support frame 88, drives an output shaft 87. A coupling 89 connects output shaft 87 to an extension shaft 84 mounted on shaft faces 72 and 73 at the top 109 of elevator shaft 50 by bearings 90 and 91 respectively. Drive sprockets 82 and 83 are mounted on extension shaft 84 outside of shaft faces 72 and 73 respectively. Sprockets 82 and 83 include gear teeth 85 which engage the links of trenching chain 52.

A drive reel 126 is mounted on extension shaft 84 inside shaft 50 for driving conveyor belt 110. Drive reel 126 is comprised of opposing sides 127 and 129 with four drive rods 130 extending between the two opposing sides, as best seen in FIG. 5. Each bucket 124 is provided with a concave cylindrically-shaped bottom 128 sized for one of drive rods 130 to fit therein. A similarly shaped idler sprocket 132 is located at the bottom 108 of elevator shaft 50 for contacting the bottoms 128 of elevator buckets 124. Conveyor belt 144 is positioned directly beneath buckets 124 at the shaft top 109 to catch the coal as buckets 124 are turned over. At the shaft bottom 108, cross conveyor 106 is shown for directing coal into shaft bottom 108 to be picked up by buckets 124. Any coal missed by conveyor 144 when buckets 124 are inverted at the shaft top 109 will fall to the shaft bottom 108 to be picked up by other elevator buckets 124. Although in the present embodiment trenching chain 52 and conveyor belt 110 are run by the same motor 86 the same shaft 84, it is understood that the present invention includes the possibility of running the trenching operation and the coal transporting operation at different speeds from independently operated drive mechanisms in order to provide greater versatility.

Figure 2:
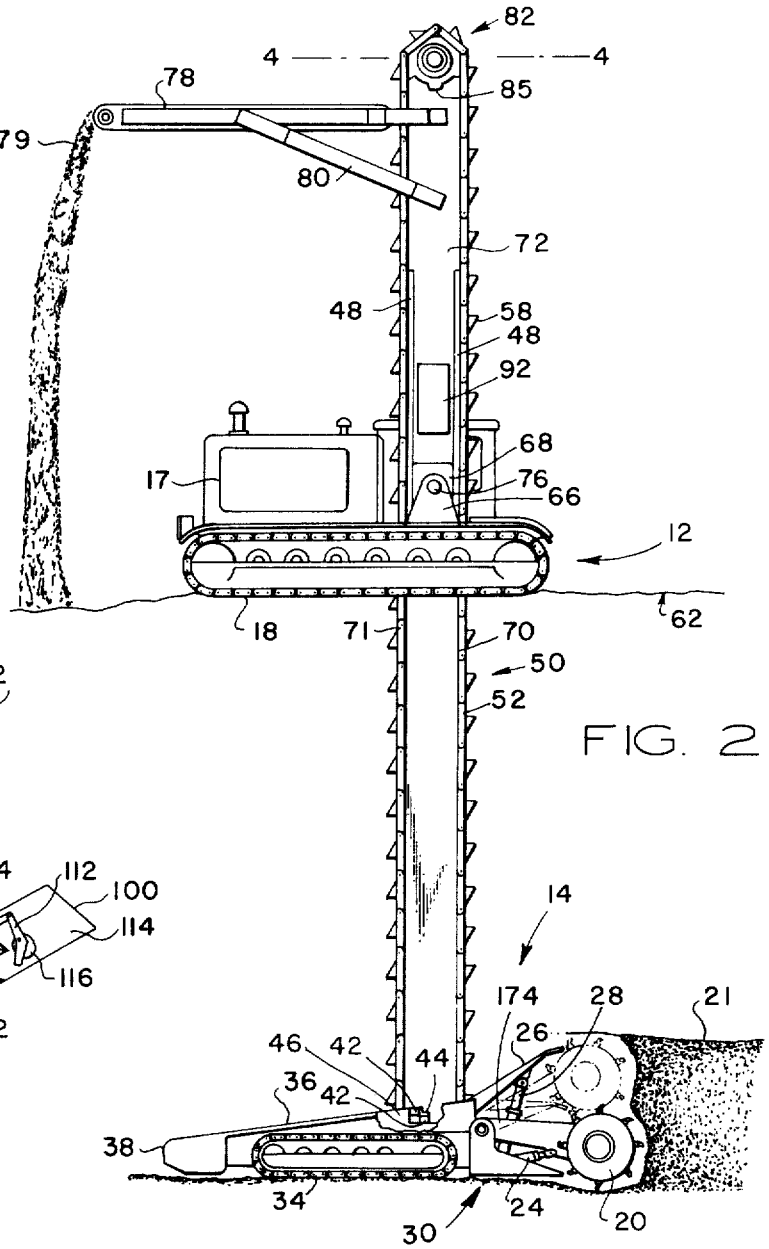
FIG. 2 is an elevation view of the invention of FIG. 1 with the underground machine partially cut away.

As shown in FIGS. 1 and 2, a conveyor 78 is mounted near the top 109 on the outside of trenching shaft 50. Conveyor 78 is attached by rigid connecting members 57 on shaft faces 72 and 73 and is supported by braces 80. Conveyor 78 is located adjacent trenching chain 52 to catch the diggings 79 from the digging teeth 58 as they invert at the top of shaft 50. Conveyor 78 is positioned to extend horizontally backward behind the back of surface vehicle 12 to deposit diggings 79 in trench 54.

Figure 8:
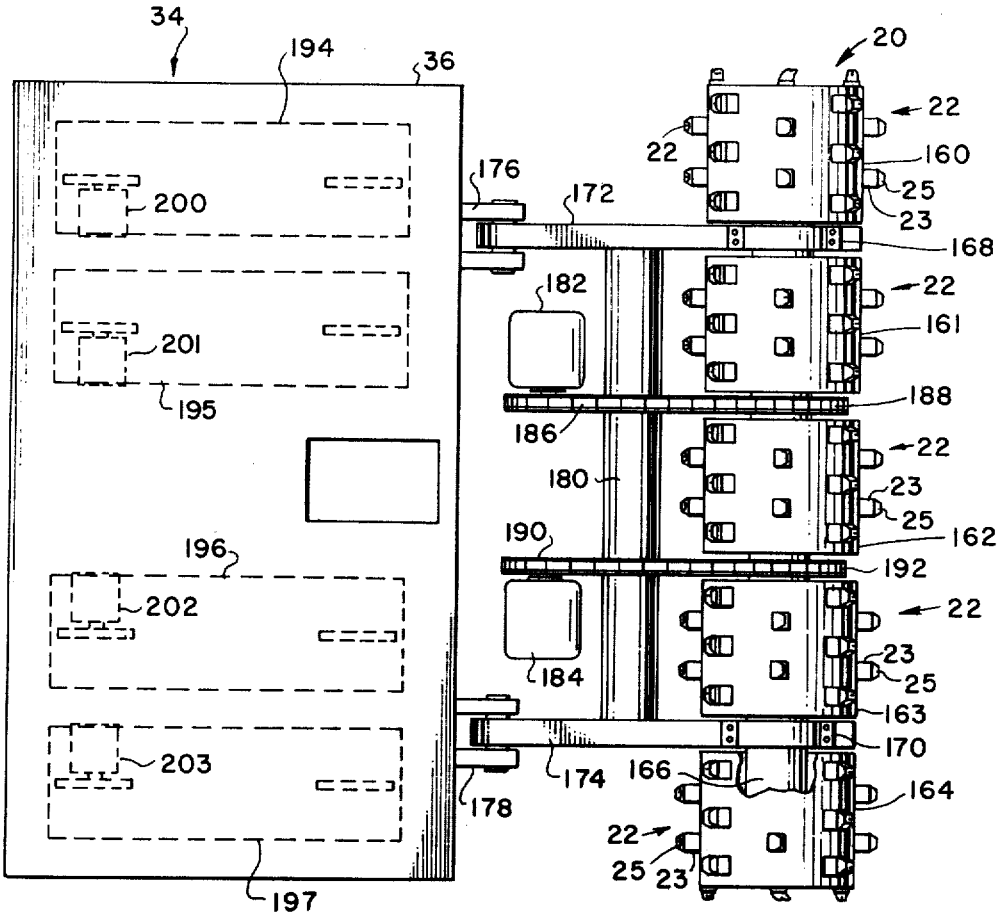
FIG. 8 is a plan view of the underground mining machine of the present invention shown in FIG. 1.

Referring now to FIG. 8, the structure of underground mining machine 14 is shown in greater detail. Rotary cutter drum 20 comprises five cutter units 160–164, each including alternating rows of three and two conventional cutter teeth 22 extending radially outward from the unit. Teeth 22 are each provided with a rectangular base 23 having a claw 25 thereon of conventional cutting material. Typically, claws 25 are made of tungsten carbide steel. Cutter units 160–164 are concentrically positioned on a cutter shaft 166 which is rotatably mounted on support arms 172 and 174 by bearings 168 and 170, attached between cutter units 160 and 161, and cutter units 163 and 164, respectively. Support arms 172 and 174 in turn are attached to brackets 176 and 178 which form a part of support member 102 on the front of the main body of underground mining machine 14. A cross member 180 extends between support arms 172 and 174 behind rotary cutter drum 20.

Drum 20 is driven by two motors 182 and 184 mounted to the front of mining machine 14. Motor 182 is connected to an endless chain 186 which drives a sprocket 188 mounted on cutter shaft 166 between cutter units 161 and 162. Likewise, the output of motor 184 is attached to an endless chain 190 which in turn drives a sprocket 192 mounted on cutter shaft 166 between cutter units 162 and 163.

The track driving system 34, shown in FIG. 8 by dotted lines beneath slanted cover 36, consists of four crawler units 194–197 powered by electric motors 200–203, respectively, which receive power from surface vehicle 12 through the elevator shaft 50. Track driving system 34 is preferably coordinated with chain drive motors 182 and 184 to provide the cutting speed for rotary drum 20 to which will match the forward speed of crawler units 194–197.

In operation, the coal mining apparatus 10 of the present invention moves as a unit as shown in FIGS. 1 and 2. Power is supplied from prime mover 17 to start the systems in surface vehicle 12, trencher/elevator 16 and underground mining machine 14. The rotary cutter drum 20 revolves to dig into coal deposit 21 and break the coal into transportable pieces. The coal pieces are then scooped up by gathering arms 112 and pushed through slots 122 in the wedge-shaped member 100. The coal pieces are transported over feed conveyors 104 to cross conveyors 106 and thence to the bottom 108 of trenching shaft 50. Conveyor belt 110 is actuated by motor 86 so that elevator buckets 124 pick up the coal at the bottom 108 of trenching shaft 50 and lift it to the surface. As each bucket 124 nears the top 109 of shaft 50 it is tipped upside down to dump the coal pieces onto belt 144 of inside loader arm 142. The coal pieces are transported to conveyor belt 148 of outside loader arm 146 and are loaded into a standard transporting truck 198 shown in FIG. 9.

As surface vehicle 12 and underground mining machine 14 move forward, the trencher/elevator 16 is directed against the overburden 56. Motor 86 also turns sprockets 82 which in turn drive trenching chain 52 to dig narrow trench 54 as a passageway for trenching shaft 50. The diggings 79 which are lifted to the surface 62 by digging teeth 58 are deposited on conveyor 78 and dropped behind surface vehicle 12 to refill trench 54.

Figure 9:
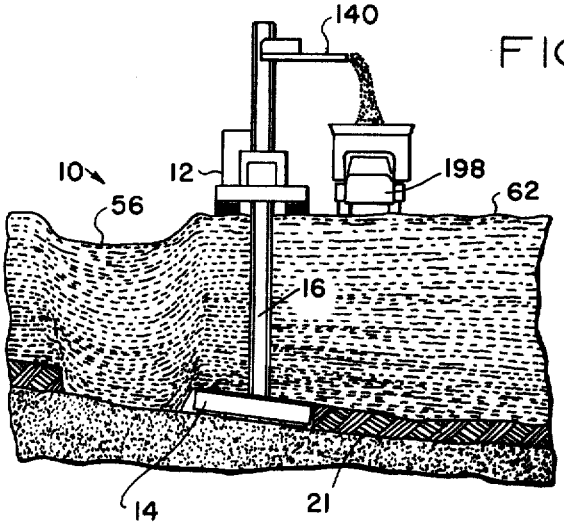
FIG. 9 is a diagrammatic front view of the coal mining apparatus of FIG. 1 in operation, with a cross section of the overburden adjacent the coal mining apparatus.

As shown in FIG. 9, the coal mining apparatus 10 of the present invention is able to cut successive swaths through the coal deposit 21 with a minimum of disturbance to the overburden 56. In FIG. 9, the mining apparatus 10 is moving along its second swath through coal deposit 21, overburden 56 having dropped to fill the excavation left by the previous path of mining machine 14. A variety of different swath patterns may be utilized depending upon the size and depth of the coal seam and the terrain above the seam.

It is understood that the angle of the earth's surface 62 will vary and will not normally be parallel with the coal seam 21 beneath the earth. Thus, surface vehicle 12 and underground mining machine 14 will normally be tipped at an angle with respect to each other. Shoe 68 is attached to elevator shaft 50 to allow for pitch, roll and yaw of the surface vehicle 12 relative to elevator shaft 50. FIG. 6 shows one means for allowing the necessary movement between the shaft 50 and surface vehicle 12. Other suitable connection mechanisms may be used to allow the necessary freedom of movement.

Figure 6A:
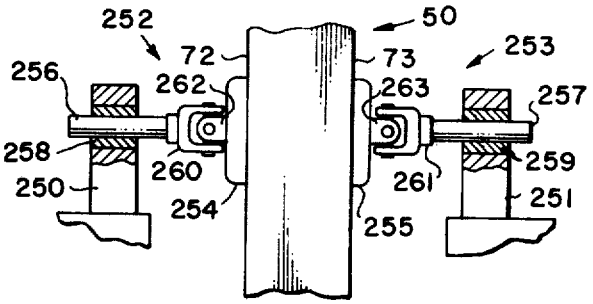
FIG. 6A is a partial side view of an alternate support means for the trenching shaft of the coal mining apparatus of FIG. 2.

An alternate means for supporting elevator shaft 50 is shown in FIG. 6A. Trunnion brackets 250 and 251 are mounted vertically on surface vehicle 12 adjacent sides 72 and 73. Universal joints 252 and 253 extend horizontally between brackets 250 and 251 and shaft faces 72 and 73, being connected to support pieces 254 and 255 respectively, mounted on faces 72 and 73. Universal joint 252 comprises a spring biased support rod 256 rotatably mounted in a bearing 258 in bracket 250. A conventional universal member 260 is reciprocably positioned in support rod 256 and is connected to a mating universal piece 262 rigidly attached to support piece 254. Universal joint 253 is similar comprised of a spring biased support rod 257 mounted in a bearing 259 and supporting a universal member 261 connected to a mating universal piece 263. It can be seen that the support assembly shown in FIG. 6A provides for pitch, roll and yaw motions of surface vehicle 12 relative to elevator shaft 50. Limited transverse motion between vehicle 12 and shaft 50 is also allowed by the spring loaded rods 256 and 257.

Relative motion between underground mining machine 14 and elevator shaft 50 is also provided for by the present invention. Such motion is much less than the relative motion between surface vehicle 12 and shaft 50 and is preferably absorbed by rubber shear mounts 42 connected to angle iron member 44 as shown in FIG. 2. Similar shear mounts and an angle iron member are provided on the opposite side of elevator shaft 50. Other types of mounting means may be used as needed without departing from the scope of the present invention.

Coal deposit 21 will vary in depth from the surface of the earth, so that the vertical distance between surface vehicle 12 and underground mining machine 14 will change. Slideable shoes 68 and 69 are constructed to slide vertically between guide ribs 48 and 49, thus allowing elevator shaft 50 to move vertically within opening 63 to compensate for these vertical distance variations. Elevator shaft 50 is preferably supported by mining machine 14 so that there will normally be no relative vertical motion between shaft 50 and machine 14.

It is contemplated that the mining apparatus of the present invention will be most useful in mining relatively shallow coal deposits, such as lignite, at depth of 20 to 50 feet beneath the surface of the earth. However, the present invention is not limited to these depths and could be modified to dig 80 feet or deeper as necessary to recover bitumious coal or other deeper deposits. Where it is necessary to mine beneath the water table, a dewatering process may be utilized to allow the machine to operate. The present invention is also useful in mining many other types of subterranean materials although minor modifications may be needed.

In a preferred embodiment of the present invention the underground mining machine 14 is 40 feet in width and about 25 feet in overall length. The rotary cutter drum 20 is 44 inches in diameter and can cut a swath having a vertical depth of about 96 inches utilizing the protruding cutter teeth 22 and the hydraulic arms 24 to raise and lower the cutter drum 20. At normal speed, rotary cutter drum 20 turns about 52 revolutions per minute with a peripheral speed of 600 inches per minute. The elevator shaft 50 is 36 inches in width on sides 70 and 71 and 72 inches wide on faces 72 and 73. At normal speeds, trenching chain 52 and conveyor belt 110 run at speeds of 250 to 300 feet per minute to convey the coal and diggings to the earth surface. The prime mover 17 is preferably a standard 2400 horsepower diesel engine connected to an electric generator. Power from the generator is supplied through trenching shaft 50 by way of power cables 96 to electric motors 200–203 of track driving system 34 and to the motors running the cutting and conveying systems.

Figure 10:
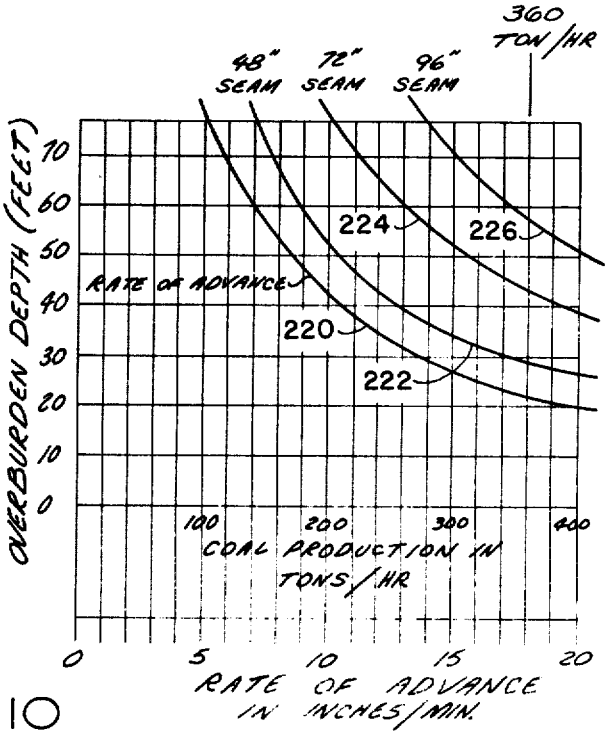
FIG. 10 is a graph showing the coal production and rate of advance as a function of the overburden depth for the coal mining apparatus of the present invention.

Referring to FIG. 10, a graph is shown indicating expected production and rate of advance figures for the present invention. A rate of advance curve 220 is plotted showing the advance rate in inches per minute in relation to the overburden depth in feet. As might be expected, the rate of advance for the machine increases as the overburden depth decreases from about 5 inches per minute at 80 feet depth to approximately 20 inches per minute at a depth of 20 feet. Of course, the relationship shown may be varied considerably depending upon the type of soil encountered in the overburden, the amount of water present and many other factors. Three production curves 222, 224 and 226, show the amount of coal production in tons per hour as a function of overburden depth for three different coal seam thicknesses at a fixed rate of advance. For example, at a maximum coal seam thickness of 96 inches and an overburden depth of 58 feet, it is expected that about 360 tons per hour can be mined. Again, the amount of coal production actually obtained at a given depth for a given coal seam thickness depends also upon other parameters as well, such as the type of overburden material and the hardness of the coal deposit.

From the foregoing it will be understood that the present invention provides for many advantages over current mining practices. By using the machine of the present invention one can mine coal or other subterranean material from beneath the earth with only minor disturbances of the earth's surface. The narrow trenches which are dug are immediately refilled by the same dirt which was removed to form the trench. The mine material is conveyed directly to the earth's surface and easily loaded into transport trucks without any substantial waste or stockpiling. The cutting action of the trencher together with the sloped covering shield on the underground mining machine allow the overburden to settle gradually and evenly into the areas excavated by the underground mining machine. Since underground crews are not needed, the safety factor of the mining operation is substantially improved. Maintenance and servicing of the mining apparatus is facilitated by the accesssway in the hollow elevator shaft.

The underground mining machine may be placed into operation in a number of different ways. One preferable approach is to dig a ramp down to the coal seam and then push or drive the underground mining machine into position adjacent the seam. The surface vehicle is situated above the underground mining machine and the trencher/elevator is lowered through the opening in the surface vehicle and is mounted on the underground mining machine. An alternate approach is to position the surface vehicle directly on top of the underground mining machine with the trencher/elevator already in position on the surface vehicle. The apparatus is then moved part way down a ramp toward the coal deposit. The surface vehicle and the underground mining machine are then separated so that the surface vehicle rides an upper ramp back to the surface of the earth as the underground mining machine proceeds down the lower ramp to the coal mine seam.

Other similar methods may be used depending upon the type of terrain and other circumstances encountered. A similar process may be followed to remove the underground mining machine as the mining operation has been completed.

Although preferred embodiments of the present invention have been illustrated in the accompanying drawings and described in the foregoing detailed description, it will be understood that the invention is not limited to the embodiments disclosed, but is capable of numerous rearrangements, modifications and substitutions of parts and elements without departing from the spirit of the invention. For example, in a given situation the complete underground mining machine shown connected to the bottom of the trencher/elevator may not be needed. A short trencher/elevator connected and supported only by a surface vehicle may be sufficient. Likewise, an underground mining machine and a trencher/elevator supported thereon may be utilized without a corresponding surface vehicle in some situations. Other similar modifications may be made without departing from the spirit of the present invention.

What is claimed is:

1. Apparatus for moving subterranean material to the surface of the earth, comprising:

mobile underground propulsion means for processing said subterranean material to transport said material to said surface, said mobile underground means being moveable in the direction of said subterranean material, transporting means connected to said mobile underground means and extending upward through the earth to the surface, said transporting means being adapted to move in coordination with said mobile underground means for transporting said processed subterranean material to said surface, and mobile surface propulsion means on said earth surface attached to said transporting means and adapted to move in coordination with said mobile underground means for receiving said processed subterranean material from said transporting means, said underground means and said surface means being connected to said transporting means to be moveable relative to each other and relative to said transporting means.

2. The apparatus of claim 1 wherein said transporting means includes digging means on the outside of said transporting means for cutting a passageway through said earth to facilitate movement of said transporting means with said mobile underground means and said mobile surface means.

3. Apparatus for removing subterranean material with minimal disruption of the overburden, comprising:

underground mobile propulsion means for moving beneath said overburden into said subterranean material;

mining means connected to said underground means for removing a portion of said subterranean material adjacent said underground means, including cutter means on the front of said underground mobile means for fragmenting said subterranean material, and conveyor means movable with said underground means extending from said underground means to the surface of said overburden for transporting said fragmented subterranean material through said overburden to a loading station at said surface;

digging means on said conveyor means for cutting a trench for said conveyor means to move through said overburden;

support means on said underground means adapted to move beneath said overburden with said underground means for supporting a portion of said overburden above said underground means; and mobile surface propulsion means connected to said conveyor means at the surface of said overburden for moving in coordination with said underground means to assist said conveyor means in moving through said trench in the overburden, said surface means and said underground means being adapted for movement relative to each other to adjust for variations in the depth of said subterranean material beneath said surface.

4. The apparatus of claim 3 wherein said conveyor means comprises an elongated substantially vertical enclosure having a hollow enclosed interior with an endless bucket elevator means therein for conveying the fragmented subterranean material through said overburden to said surface.

5. The apparatus of claim 4 wherein said digging means comprises an endless digging chain on the outside of said vertical enclosure having teeth adapted to remove the overburden from in front of said enclosure in the direction of travel of said conveyor means through said overburden.

6. The apparatus of claim 5 wherein said mobile surface propulsion means comprises a wide track surface vehicle connected to said vertical enclosure having controls to synchronize the movements of said wide track surface vehicle and said underground mobile propulsion means.

7. The apparatus of claim 6 wherein said underground mobile propulsion means comprises a wide track subterranean vehicle connected to the bottom of said vertical enclosure, said cutter means being mounted on the front of said subterranean vehicle, and further comprising means for directing the pieces of said subterranean material to said bucket elevator means to convey said pieces to the surface.

8. The apparatus of claim 7 wherein said support means comprises a protective shield on said subterranean vehicle to support said overburden above said cutter means, said directing means and said subterranean vehicle.

9. The apparatus of claim 8 wherein said protective shield is slanted on said subterranean vehicle at an acute angle downward from the front to the back of said vehicle to lower the overburden as said subterranean vehicle passes thereunder.

10. The apparatus of claim 9 and further comprising overburden cutting means extending substantially vertically above said underground mobile means for separating the overburden above said underground mobile means from the overburden above unmined portions of the subterranean material to facilitate uniform lowering of said overburden by said protective shield of said underground mobile means.

11. The apparatus of claim 3 wherein said surface means and said underground means are further adapted for movement relative to said conveyor means to adjust for variations in the orientation of said subterranean material relative to said surface.

12. The apparatus of claim 3 wherein said cutter means are vertically movable to cut a swath of varying height in said subterranean material, and wherein a forward portion of said support means is vertically movable to provide support for said overburden above said movable cutter means.

13. Mining apparatus for removing coal from a subterranean coal seam with minimal disruption of the overburden, comprising:

a self-propelled mobile mining machine adapted for movement along said coal seam;

cutting means on the front of said mobile mining machine for breaking said coal seam into separate pieces, including elevator means extending from said mobile mining machine through said overburden to lift said coal pieces to the surface of said overburden, and means for directing said coal pieces from the cutting means to the elevator means;

conveyor means for removing said coal pieces from in front of said mobile mining machine;

driving means for moving said mobile mining machine forward as said cutting means and said conveyor means open a passageway in said coal seam;

support means for partially supporting said overburden above said mobile mining machine and for gradually lowering said overburden as said mobile mining machine passes thereunder to fill in the passageway cut by said mining apparatus;

a self-propelled surface vehicle attached to said elevator means at the surface of said overburden, said surface vehicle being synchronized to move in cooperation with said mobile mining machine and said elevator means;

first attachment means for connecting said elevator means to said mobile mining machine and adapted to provide for movement of said mobile mining machine relative to said elevator means; and second attachment means for connecting said elevator means to said surface vehicle and adapted to provide for movement of said surface vehicle relative to said elevator means, and relative to said mobile mining machine.

14. The apparatus of claim 13 and further comprising separating means extending above said mobile mining machine for dividing the overburden above said machine from the overburden above unmined portions of the coal seem to facilitate lowering of said overburden by said support means.

15. The apparatus of claim 13 and further comprising digging means on said elevator means for digging a trench in said overburden for said elevator shaft to move with said mobile mining machine.

16. The coal mining apparatus of claim 15 wherein said digging means comprises an endless chain conveyor having spaced digging teeth on the front side of said elevator means relative to the direction of movement of said elevator means adapted to move upward toward said surface to remove portions of said overburden and thereby cut a trench for said elevator means.

17. The coal mining apparatus of claim 16 and further comprising means at the top of said elevator means for receiving said portions of overburden from said spaced digging teeth and for replacing said portions in said trench behind said elevator means.

18. The coal mining apparatus of claim 13 wherein said elevator means comprises a hollow closed housing extending from said mobile mining machine to the surface, and an endless bucket conveyor inside said housing communicating between said directing means and the surface.

19. The coal mining apparatus of claim 18 and further comprising loading means in communication with said endless bucket conveyor for receiving said coal pieces from said bucket conveyor and for loading said coal pieces into transport vehicles adjacent said loading means.

20. The coal mining apparatus of claim 13 and further comprising power means on said surface vehicle for driving said surface vehicle and for communicating power to said driving means on said mobile mining machine.

21. A process for mining coal from an underground coal deposit using a mobile underground propulsion machine, a mobile surface propulsion vehicle and an interconnecting conveyor shaft, with minimal disruption of the overburden, comprising the steps of continuously:

burrowing said underground machine into said coal deposit, breaking said coal deposit adjacent said underground machine into transportable pieces, conveying said transportable pieces along said conveyor shaft to said mobile surface vehicle, driving said surface vehicle in coordination with said underground machine, cutting a passageway through said overburden between said underground machine and said surface to provide a path for movement of said interconnecting conveyor shaft in coordination with said underground machine and said surface vehicle, and remotely controlling the operation of said underground machine from said surface vehicle.

22. The process of claim 21 and further comprising supporting said overburden above said mobile underground machine and gradually lowering said overburden behind said underground machine to replace said pieces of subterranean material conveyed to the earth surface.

23. In mining apparatus for removing subterranean material from beneath the earth to the surface using self-propelled mobile underground digging means the combination comprising:

vertical conveyor means including an enclosed housing extending from said underground digging means through the overburden to said surface to keep said overburden out of said housing;

elevator means on said conveyor means within said enclosed housing for transporting said subterranean material to said surface without contaminating said material with said overburden;

drive means connected to said conveyor means for moving said conveyor means through said overburden in coordination with the movement of said underground digging means, including self-propelled mobile surface means attached to said vertical conveyor means at said surface adapted for moving in coordination with the movement of said underground digging means, and for controlling the movement of said underground digging means, and cutting means on said conveyor means for cutting a passsageway through the overburden for said conveyor means to move in coordination with said underground means and said surface means;

power communication means extending to said underground means through said enclosed housing for transporting power from said surface means to drive said underground means; and control communication means extending to said underground means through said enclosed housing for transporting control signals from said surface means to control said underground means.

24. Apparatus for removing subterranean material from beneath the earth, comprising:

mobile underground means for burrowing into said subterranean material, including digging means for breaking up said subterranean material and means for driving said mobile underground means into said material;

transporting means movable with said mobile underground means for conveying said broken subterranean material from said digging means to a loading station, including means extending to the surface of the earth from said mobile underground means for lifting said subterranean material to the surface; and remote control means in communication with said digging means and with said driving means for controlling the operation of said mobile underground means from a remote station, including mobile surface propulsion means connected to said lifting means for moving in coordination with said mobile underground means.

25. A process for removing subterranean material using a self-propelled underground mining machine with minimal disruption of the overburden, comprising:

continually moving said mining machine toward said subterranean material;

supporting the overburden above said mining machine;

processing said subterranean material adjacent said mining machine into transportable form;

conveying said processed subterranean material through the overburden to the earth surface by a substantially vertical conveyor moving through the overburden in coordination with said mining machine;

digging a substantially vertical trench through said overburden above said mining machine to provide a path for said conveyor to move through said overburden and to convey said processed subterranean material to said surface as said mining machine moves toward said subterranean material;

lowering said supported overburden behind said mobile mining machine as said machine moves continually toward said subterranean material; and moving said mining machine relative to said conveyor to maintain said conveyor substantially vertically disposed while the orientation of said mining machine changes as it moves toward said subterranean material.

26. The process of claim 25 and further comprising the step of filling said vertical trench with the diggings from said overburden after said subterranean material has been conveyed through said trench.

27. The process of claim 25 and further comprising separating the portion of said overburden supported above said mobile mining machine from adjacent overburden portions to facilitate lowering of said separated overburden portion behind said mobile mining machine.

28. A process for removing subterranean material using a mobile underground mining machine with minimal disruption of the overburden, comprising:

continually moving said mobile underground mining machine toward said subterranean material;

breaking said subterranean material adjacent said mobile underground mining machine into transportable pieces, continually cutting a passageway through said overburden for a conveyor extending from said mining machine to said surface for said conveyor to move forward in coordination with said mining machine;

lifting said pieces of subterranean material along said conveyor from said mining machine to said surface;

supporting said conveyor at the earth surface using a mobile surface vehicle moving in coordination with said mobile mining machine; and moving said mining machine and said surface vehicle in relation to each other to adjust for variations in the depth of the subterranean material relative beneath the earth surface.

29. The process of claim 28 and further comprising the step of loading said pieces of subterranean material from said conveyor to a transport vehicle.

30. The process of claim 28 and further comprising replacing the overburden which was removed to form the passageway for said conveyor back into said passageway after said conveyor has passed therethrough.

* * * * *